United States Patent [19]

Meier-Windhorst

[11] 3,955,386

[45] May 11, 1976

[54] APPARATUS FOR THE CONTINUOUS LIQUID TREATMENT OF RUNNING LENGTHS OF MATERIALS

[75] Inventor: Christian August Meier-Windhorst, Lindhorst via Hamburg-Harburg, Germany

[73] Assignee: Artos Gesellschaft fur Industrielle Forschung und Entwicklung C.A. Meier-Windhorst, Maschen via Hamburg-Harburg, Germany

[22] Filed: Apr. 12, 1974

[21] Appl. No.: 461,190

Related U.S. Application Data

[60] Continuation-in-part of Ser. No. 136,275, March 16, 1971, abandoned, which is a division of Ser. No. 845,677, July 23, 1969, abandoned.

[52] U.S. Cl. ..... 68/5 D; 68/15; 68/175; 68/181 R

[51] Int. Cl.[2] ..... D06B 3/20

[58] Field of Search ..... 68/5 D, 5 E, 9, 15, 68/20, 27, 175, 181 R, 184

[56] References Cited

UNITED STATES PATENTS

| | | | |
|---|---|---|---|
| 663,452 | 12/1900 | Maertens | 68/184 X |
| 2,516,268 | 7/1950 | Spalding et al. | 68/175 |
| 2,641,121 | 6/1953 | Belcher | 68/181 R |
| 2,674,113 | 4/1954 | Schrenk | 68/181 R X |
| 3,058,327 | 10/1962 | Hablutzel et al. | 68/5 E |
| 3,058,332 | 10/1962 | Hoffman | 68/181 R |

FOREIGN PATENTS OR APPLICATIONS

| | | | |
|---|---|---|---|
| 314,721 | 10/1919 | Germany | 68/9 |

*Primary Examiner*—Peter Feldman
*Assistant Examiner*—Philip R. Coe
*Attorney, Agent, or Firm*—Allison C. Collard

[57] ABSTRACT

Apparatus for the continuous liquid treatment of a running web of a textile material and the like comprises a set of horizontally disposed treatment tanks, means for introducing the web into and through the tanks, means for introducing and distributing treating liquid over the width of the web, and for removing both web and used liquid, and control means for maintaining the depth of treating liquid at a level whereby there is associated with each unit length of web a predetermined quantity of treating liquid during its passage through the apparatus, with means for moving web and liquid through the apparatus at substantially the same speed and in the same direction whereby substantially complete extraction of the treating agent from the liquid is obtained.

8 Claims, 12 Drawing Figures

APPARATUS FOR THE CONTINUOUS LIQUID TREATMENT OF RUNNING LENGTHS OF MATERIALS

This is a continuation-in-part of application Ser. No. 136,275, filed Mar. 16, 1971 and now abandoned, which is in turn a division of application Ser. No. 845,677, filed July 23, 1969 and now abandoned.

BACKGROUND OF THE INVENTION

The present invention relates to apparatus for the continuous finishing liquid treatment of full-width material webs, in particular textile webs, such as woven or knitted webs, tufted textile webs, fiber fleeces, yarn slivers, fiber rovings and the like.

In the continuous finishing treatment of textiles it is a paramount principle that a constant maintained quanity of a liquid containing the finishing media or agents in a constantly maintained concentration is applied to the web to be treated such as, for example, a foulard fabric, in a suitable finishing apparatus. In such treatment the volume of the bath through which the web is passed must be as small as possible in order that it can be continuously renewed from the continuously flowing treatment medium.

The particular processing medium used is in such cases usually applied at a low or medium temperature. Apart from some cold steeping techniques and methods in which the web impregnated with the processing medium is subsequently dried, the treatment is concluded with processing in moist heat, preferably water vapor, in which the web and the applied processing medium are conjointly heated to a suitable reaction temperature and held at such temperature for a specified time. This technique, of continuously applying a process medium at low or medium temperature in controlled quantity with ensuing conjoint heating of the process medium and the processed material to an optimum temperature and subsequent holding at that temperature, is usual today in continuous finishing and in certain dyeing treatments in which absolute consistency of the concentration of the process medium applied to the textile material from beginning to end of a particular batch, is required.

Owing to this requirement, continuous finishing treatment in hot processing liquids with a necessarily large volume which are, as a rule, heated independently of the material web being treated, with the impregnation by the process medium and the treatment by reaction heat being combined in a single operation, has hitherto been restricted to lower quality requirements or methods, the results of which are not so greatly dependent on the particular concentration of the treating bath.

To solve these problems, efforts have been made in the prior art to greatly reduce the volume of treatment liquid. In the so-called Williams unit, displacement elements are inserted between the vertical web guides. However, this unit can only be used, for instance in continuous dyeing, either for batches of more than 10,000 meters, or if the requirement for uniform end-dyeing is relaxed. Consequently, despite its great inherent advantages, continuous hot-liquid treatment has not come into general use in competition with the batch processes involving separate application of the finishing media with following heating and holding at elevated temperature.

GENERAL DESCRIPTION OF THE INVENTION

The present invention has as an object the provision of apparatus for treatment with hot liquids, and which permits (a) working with substantially lower concentrations of the process liquid than in the case of application by impregnation; (b) treatment by processing media contained in the bulk of a process liquid entirely surrounding the whole structure of the material, i.e., filling all interstices and voids therein; (c) affording the possibility of easier migration of particular constitutents of the processing medium to particular parts of the textile structure, i.e., as in differential dyeing; (d) thereby also achieving better penetration of the textile structure by the process medium; (e) substantially greater facility for heating the process medium separately and independently of the material web to be processed; (f) allowing greater care in handling the material structures, especially with more delicate materials since squeeze concentrations, as in the standard impregnation methods, do not occur; and (g) afterwashing is made a simple problem since the application of thickeners or the like, is rendered superfluous the processing characteristics of the medium being maintained throughout the process with high consistency of medium concentration and uniformity of treatment.

In accordance with the present invention, there is provided an apparatus for the continuous liquid finishing treatment of flat-spread webs, in particular textile webs such as woven and knitted webs, tufted webs, fibrous fleeces, yarn bundles, and fibrous bands, with chemical reagents or dye transfer and fixing agents in a processing medium which is heated independently of the material web to a suitable reaction, dyeing, fixing or mordanting temperature, wherein with each unit length of the material web to be processed there is associated, during its passage through the apparatus, from the entry of the corresponding batch of material, a predetermined quantity of processing liquid travelling unidirectionally therewith and having an initial predetermined chemical and physical constitution, the finishing process being so timed that for chemical treatments, exhaustion or consumption of the processing medium, and in dyeing, a substantially complete extraction of the dyestuff from the processing liquid, is obtained.

The present invention provides liquid treatment apparatus in several embodiments, all applying, however, the same general principles of operation. The construction and operation of the apparatus will be better understood by reference to the accompanying drawings, in which.

Figure 2:
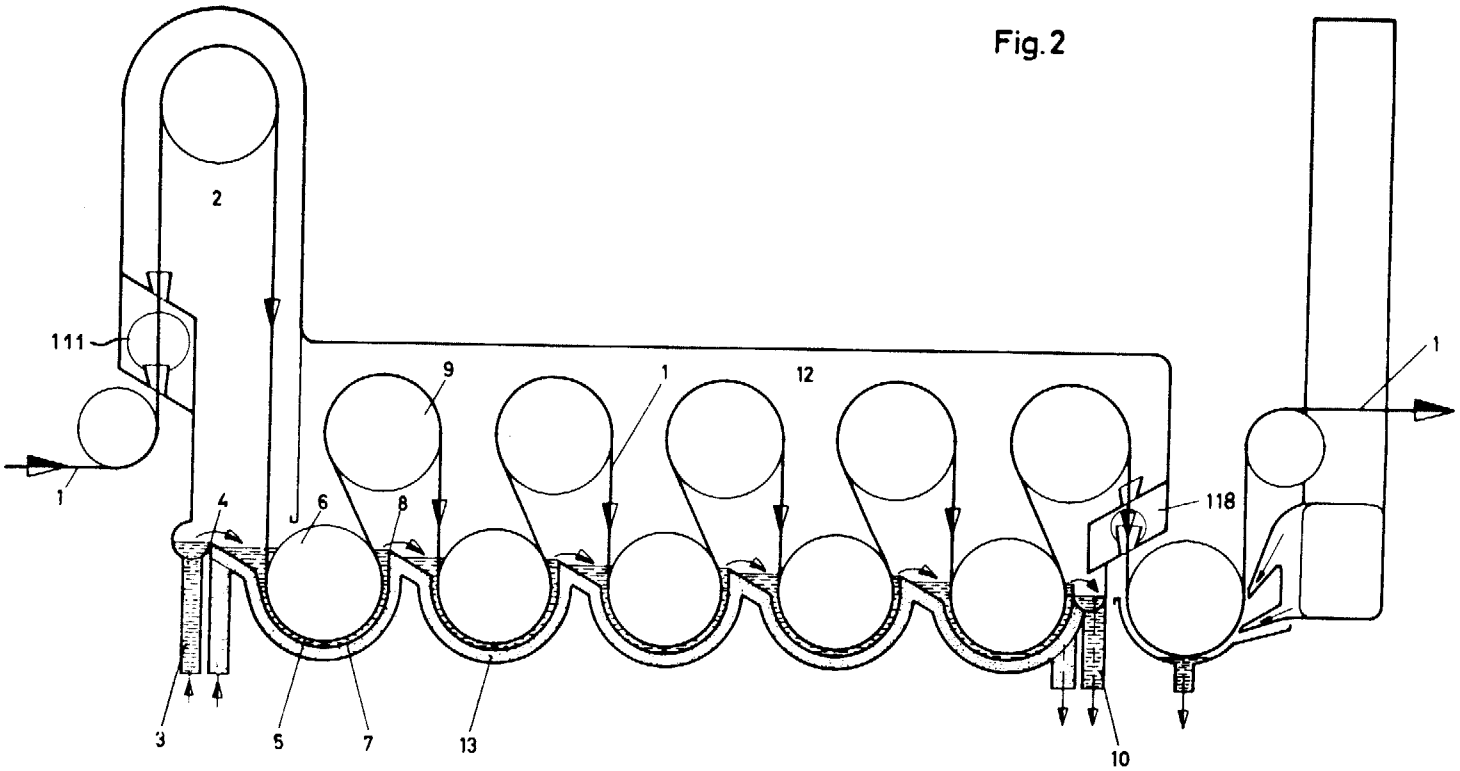
FIG. 2 is a schematic arrangement in vertical section of an embodiment employing sets of upper and lower web guide rollers over which the web passes, the treating liquid being contained in a series of underlying trays.

Referring to FIG. 2, there is illustrated a presently preferred embodiment of the invention including a series of horizontally arranged upper guide rollers 9 with which a corresponding series of lower guide rollers 6 is associated, to provide an alternating roller guiding arrangement or which with corresponding driving and controlling means (not shown) forms a static hanging-loop system. Arranged around the lower guide rollers 6 are semicylindrical dishes or bowls, providing an interconnecting system of processing trays 7 adapted to contain treating liquid, with height-adjustable overflow means 8 arranged between successive trays, the heights from tray to tray being successively lower, as shown in FIG. 2, to permit flow of liquid downward from one tray to the next. The material web 1 to be processed is led into the apparatus via a lock element 11A, passing directly to and around the first lower guide roller 6, thence up and over upper guide roller 9, and continuing around pairs of opposing rollers, until it leaves the apparatus via lock element 11B. The respective sets of upper and lower guide rollers are arranged so that the axes of the upper rollers are not in alignment with the axes of the lower rollers. The upper rollers are adapted to transmit the running length of web, i.e. they may, if desired, be power driven. The processing trays 7 are constructed so that each has a radius slightly larger than the radius of the corresponding lower guide roller with which it is associated.

A supply of treating liquid 3 is fed into the first tray over edge 4, forming therein a liquid bath 5 into which the web is guided by roller 6, there being a small gap between the surface of roller 6 and the bottom of the tray 7. A further overflow 8 conducts the treating liquid into the next bath, while the web is deflected over the counter-running roller 9 and then enters the next treatment bath, in the manner shown in FIG. 2, the material web and the processing liquid — their respective speeds being carefully matched — pass through the entire finishing process. A steam-filled space designated generally as 2 is provided at the entry portion of the apparatus for preheating and deaerating the usually dry material web. The treating liquid is usually preheated to process temperature. The apparatus is advantageously enclosed within a cover to form a chamber 12 which is steam-filled when working with aqueous solutions. All the treatment baths 7 are equipped with jackets 13 for heating by steam or liquid. This supplements the preheating and reheating of the process liquid during the passage of the web, and maintains the liquid at the required temperature. Aqueous solutions are preferably raised to their boiling temperatures; in the case of higher boiling solvents in the processing liquid, a suitable temperature is maintained, usually between 120° and 200°C. In the arrangement shown in FIG. 2, the supplementary heating, when working with aqueous solutions as processing liquid, produces forced generation of steam in the bath containers which provides the requisite highly turbulent motion of the liquid at the surface of the web. Processing liquid leaving the apparatus may be collected and fortified and recycled if appropriate.

Figure 3:
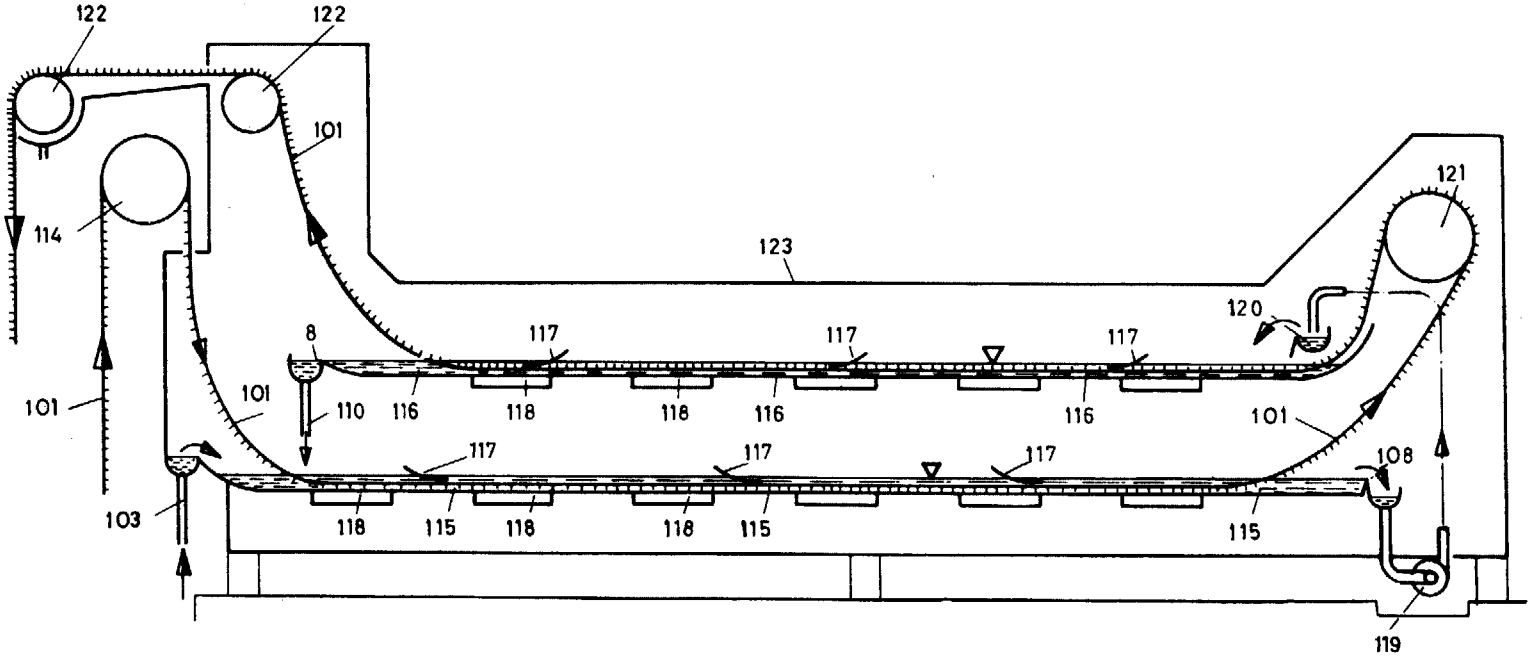
FIG. 3 is a schematic arrangement in vertical section of an alternative embodiment in which the material web is passed laterally through liquid processing trays.

FIG. 3 illustrates an alternative embodiment, especially suitable for the continuous dyeing of heavy textile fabrics, in particular carpets with pressure-sensitive pile. The material web 101 is passed into the apparatus via raising and entry roller 114. Since the web is still cold at this point, it can still be left in contact with roller 114 on its side which is sensitive at higher temperature in the wet state. The apparatus includes one or more elongated, horizontally arranged treatment tanks or vats, of which the lower set is designated by 115, and the upper set by 116. These are arranged to receive the material web and the processing liquid at one end thereof with distribution of the latter over the width of said web at said one end and having means for removing both at the other end thereof, and including control means for regulating the level of the open surface of the liquid or alternatively with covering and limiting surfaces above the same so as to allow adjustment of the depth of the processing liquid in a manner such that there is associated with each unit length of material to be processed, during its passage through the finishing process, a predetermined quantity of liquid.

As shown in FIG. 3, the treating liquid which has been preheated enters the apparatus via inlet 103, flowing into the lower, shallow, elongated treatment vat 115, through which the web 101 is moved horizontally. The emerging web passes upward and around roller 121, and downward and in the reverse direction through upper shallow elongated treatment vat 116, and finally upward and out of the apparatus via rollers 122. Means for holding down the material, such as spring clips, designated as 117, are provided to assure that the material web is continually held below the surface of the liquid. Both the lower and upper treatment vats are provided with suitably spaced auxiliary heating means designated generally at 118, which extend across the whole width of the shallow process vats, which again can alternatively be heated by low pressure steam or high-boiling heating liquids. The used treating liquid from the lower vat is removed by overflows 108, which control the liquid levels in the lower and upper vats, respectively, and thereby also the preselected ratio of circulating weights of material and process medium, respectively, as well as the outflow from the individual treatment vats. The pump 119 pumps the process liquid issuing from the lower processing vat 115, through the feed distributor 120, and into the upper treatment vat. The material conveying, transferring and guiding roller 121 conveys the material web from the lowest to the uppermost treatment vat. The withdrawing rollers 122 lift the processed material from the end part of the uppermost processing vat and withdraw it completely from the apparatus. The whole processing space is advantageously shielded by a casing 123 from the external atmosphere. The space inside the casing 123 can suitably be kept filled with steam. The nearly completed exhausted process liquor leaves the system via discharge outlet 110 and is drained out of the apparatus.

Figures 4, 5:
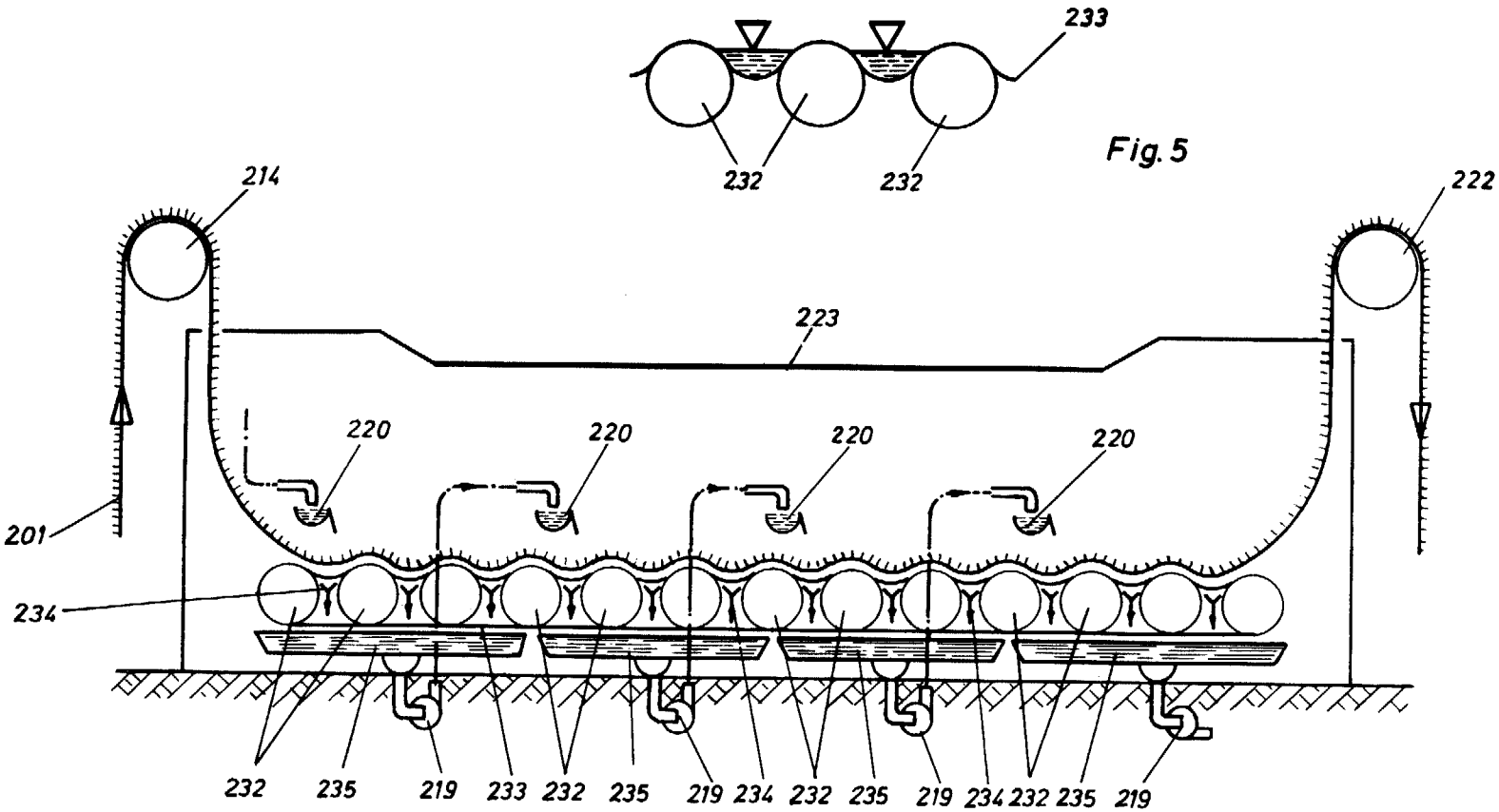
FIG. 4 is a schamatic arrangement in vertical section of another alternative embodiment in which the material web is guided through the processing liquid on a conveyor belt.
FIG. 5 shows a detail of the apparatus of FIG. 4 with the web in short, dependent loops.

In another alternative embodiment illustrated in FIGS. 4 and 5, which is especially suitable for the dyeing of heavier textile fabrics, such as carpets with pressure sensitive piles, the material web 201 to be processed is passed over a raising and conveying roller 214 into the processing space, which is suitably separated from the external atmosphere by the casing 223. The space inside the casing can suitably be kept filled with steam. At the end of the processing space, the material web 201 is conveyed out of the casing by drawing roller 222. The material web is guided through the processing space on a conveyor belt 233 which is provided with openings through which the processing liquid, after passing downwards through the web is intercepted by discharge troughs or trays 234, optionally with assistance of a vacuum. The conveyor belt 233 is of the endless type, and passes around a plurality of rollers 232, between the upper surfaces of which it may hang in a slight festoon, to contain liquid, as shown in FIGS. 4 and 5. The conveyor belt is preferably of the plate or flight type with accurately located openings for the passage of process liquid. Alternatively, it may be of the bar or batten type.

The processing space contains a plurality of treatment vats 235 which are supplied with treating liquid via a set of feed distributors 220 arranged in series along the path of the material, through which the processing liquid is fed into the unidirectional flow of material and liquid and repeatedly distributed evenly over the surface of the material. A plurality of means is provided along the conveyor for supplying the treating liquid from above the web and for collecting it after it has drained through the web, and further means is provided for conveying the liquid from each collection stage to the next following supply stage, and including control means arranged to regulate the rate of fluid flow so that with each length of web there is associated during its passage a predetermined quantity of liquid. The liquid collected by discharge troughs 234 is collected in in tanks 235, and conveyed thence by pumps 219, as shown in FIG. 4, back to the material web, or disposed of in any desired manner.

FIG. 5 shows the guiding of the material web through the processing space in short, depending loops. Here again, the processing liquid, shown in the loops, is preferentially drawn downwards after passing through the web.

Figure 6:
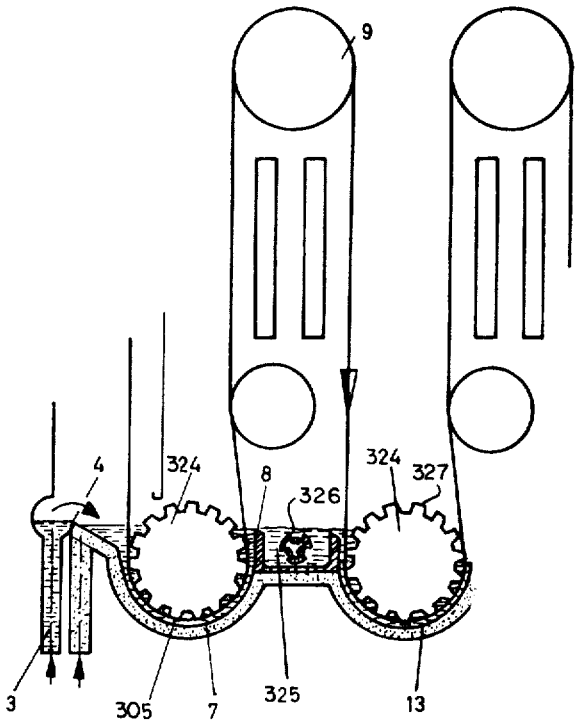
FIG. 6 is a schematic view partially in vertical section of a variation of the apparatus of FIG. 2 provided for cross-mixing of the liquid over the web.

In FIG. 6, which illustrates an alternative arrangement similar to that of FIG. 2, a mixing chamber 325 is provided between the lower guide rollers 324, in which cross-mixing of the processing liquid over the width of the web takes place. For this purpose there is provided a mixture roller 326, but other suitable mixing means, such as water sprays or the like may be used. Such mixing chambers 325, for repeated thorough mixing of the processing liquid, can be arranged behind each treatment vat 305, or assigned to groups of an arbitrary number of vats. FIG. 6 further shows a characteristic feature in the design of the lower rollers 324 which are immersed in the bath liquid. To improve penetration of the material web by the processing liquid these rollers are provided further on their periphery with a plurality of spaced longitudinally slots or grooves 327 distributed over the circumference as shwon, or with a corrugated surface, or equivalent features which will ensure that the processing liquid completely penetrates the material.

Figure 7:
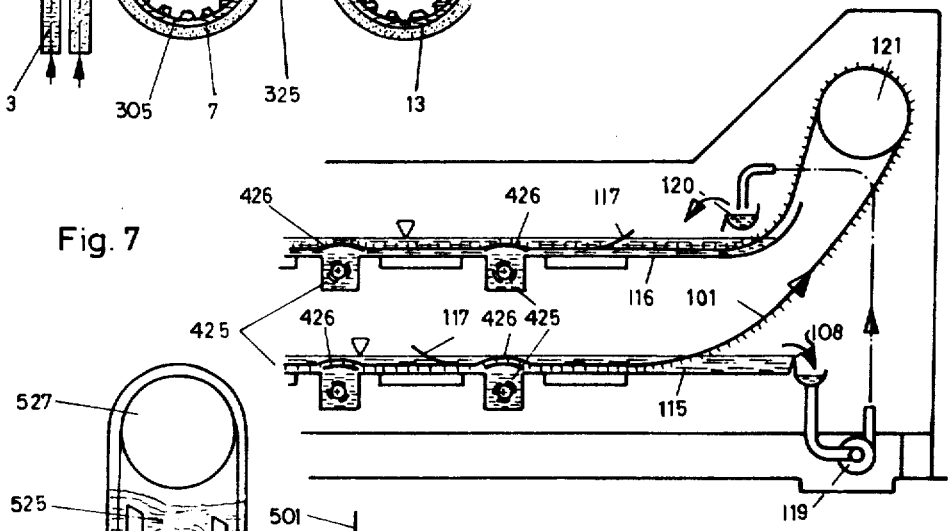
FIG. 7 shows a variation of the apparatus of FIG. 3 with provision of liquid mixing chambers.

FIG. 7 shows an arrangement of mixing chambers 425 in an apparatus corresponding to that shown in FIG. 3. The material web 101 is, in this case, guided by special guide surfaces 426, over a series of openings in which repeated cross-mixing of the processing liquid for the purpose of balancing the concentration values, is effected. The processing liquid is in this case drained away on the front side of the guiding surfaces 426, from the treatment vat, passing thence to the mixing chambers 425, is therein mixed with the processing liquid flowing from the edge of the web, and re-enters the treatment vats 115 or 116 on the rear side of the guiding surface 426.

Figure 8:
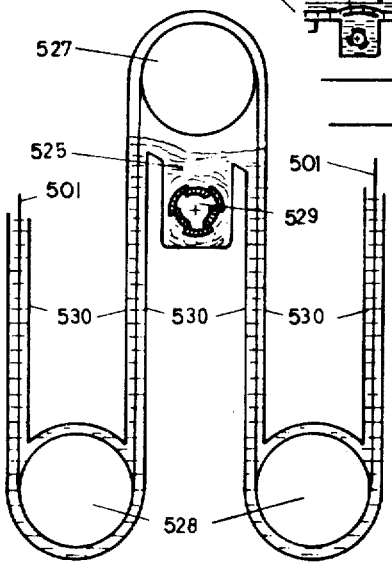
FIG. 8 shows the application of mixing chambers to the apparatus of FIG. 2.

This cross-mixing of the processing liquid over the width of the material at particular intervals in the process, can of course also be applied in other embodiments than as shown in FIGS. 2 and 3, for instance in an arrangement, as shown in FIG. 8, wherein the material web 501 is guided over top and bottom rollers 527 and 528, and baffles or displacement elements 530, between which the processing liquid and the material web travel unidirectionally, utilizing a mixing chamber 525 and impeller 529, as shown.

Figure 9:
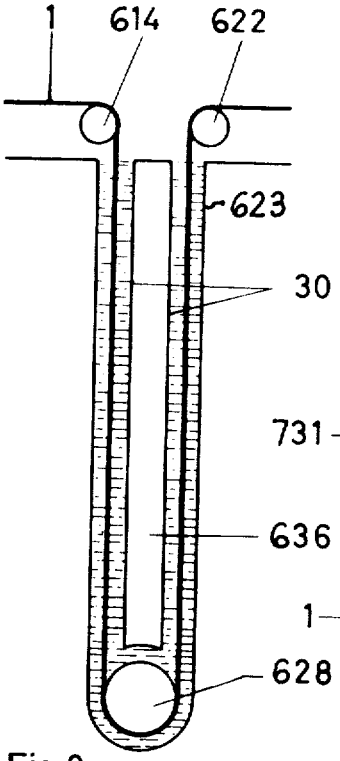
FIG. 9 shows schematically a preliminary web immersing unit adapted to be used in conjunction with the apparatus of either FIGS. 3 or 4.
Figure 10:
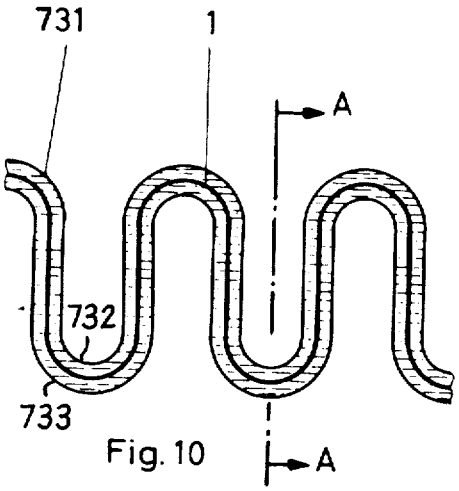
FIG. 10 is a view in section of apparatus for guidance of the material web in a wavy manner.
Figure 11:
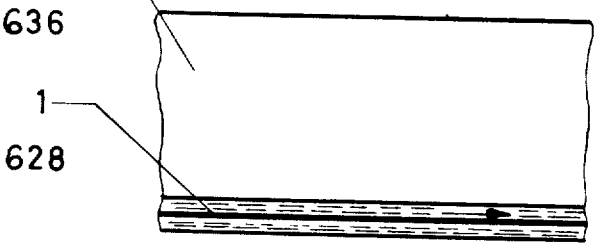
FIG. 11 is a cross-sectional view taken along the line A—A of FIG. 10.

Further variations of advantageous means for guiding of the material to be processed, are shown in FIGS. 9, 10 and 11. In the ordinary flat guiding system, as shown in FIG. 9, the material web 1 being processed is introduced over an entry conveyor roller 614 into the processing liquid, under a bottom guide roller 628, deflected, and withdrawn from the liquid by a draw-off roller 622. The vat 623 contains, for the purpose of reducing the volume of liquid, a displacement element 636 having lateral guiding surfaces 630.

Flat guiding with a wavy cross-section is shown diagramatically in FIGS. 10 and 11, FIG. 11 being a cross-sectional view along the line A—A of FIG. 10. Referring to FIG. 10, the direction of motion of the material web 1 is perpendicular to the plane of the drawing, as indicated by the arrow in FIG. 11. These Figures are intended to show the direction of motion of material web 1 through the completed section container 731, which suitably consists of an upper and lower part 732 and 733 respectively. The material web is thus in a sense flat-guided for the purpose of reducing the necessary width of the processing vat, but laid in folds.

Figure 12:
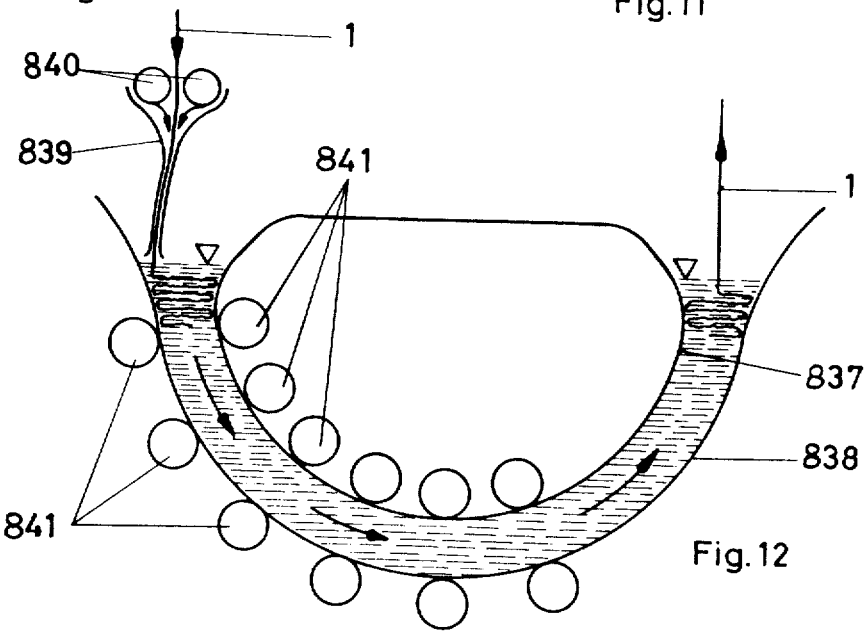
FIG. 12 shows a vertical sectional schematic arrangement of an auxiliary apparatus adapted to be attached to the apparatus of FIGS. 2, 3 or 4, for guiding the web in folds through a body of treating liquid.

It has been further found advantageous to incorporate in the guidance system for passing the material through the process bath, or at the end of a principally wide-band system, a spread-out layoff in folds, floating in the process bath. This is particularly suitable for the case where the process media have already previously been applied in a first impregnating (padding) stage with wide-web guidance over and under rollers, or in vertical guides, or looped guiding, or a preliminary application in some type of padding machine. A system of guiding the material web in part of its transit through the processing liquid or in the end part thereof, in laid folds floating in the liquid, is shown in FIG. 12. The container in this apparatus consists of double shells 837 and 838 forming together the side walls a rectangular cross-section in which the web 1 is laid in folds by a feeder device 839. The processing liquid is then introduced on both sides of the web by spouts or launders 840, as shown in the Figure, for example with a ratio of material to liquid of the order of 1:15 or 1:25. Mixing elements 841 are suitably fitted on the side walls of the double shells 837 and 838, by means of which a constantly uniform composition of the processing liquid, in particular over the width of the fabric, is assured. After passing through the trough formed by the double shells 837 and 838, the web, as shown by the arrow, is withdrawn from the container. The arrangement in FIG. 12 is such that the flow of liquid may be regulated so that there is associated with each unit length of material throughout its passage through the container, a predetermined quantity of liquid.

The most suitable ratios of the weights of process liquid and the material web respectively, lie between 10:1 and 30:1 for heavy materials, in particular furniture fabrics and woven floor coverings; and 20:1 and 40:1 for average and light weight materials.

Figure 1:
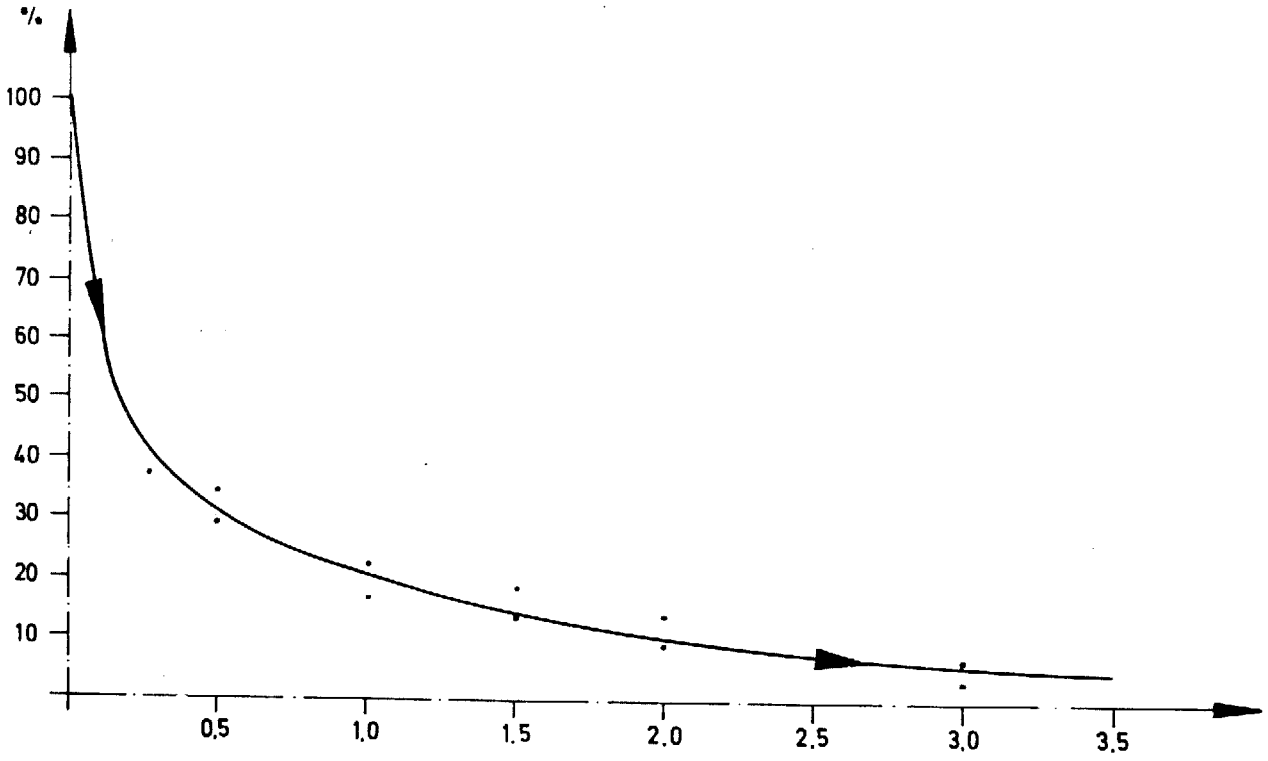
FIG. 1 is a curve showing the rate of exhaustion of a dye bath in the dyeing of a fabric in the apparatus of FIG. 2.

Using the apparatus of FIG. 2, employing a 15:1 liquid ratio for continuous extraction dyeing, tufted carpet material having a jute backing, and made with nylon 66, a textile fiber produced from hexamethylene diamine and adipic acid by the conventional condensation process, and containing about 100g/m² of polyamide fiber, in the form of a web about 2 meters in width, was subjected to exhaustion dyeing by passing continuously through the apparatus in concurrent movement therewith an aqueous solution of an acid nylon dye, C.I. Acid Blue 113 (26360) having a dye concentration of 0.2% dye by weight, and a pH between 5 and 10, the bath temperature being maintained at the boiling point (slightly above 100°C). Separate heating of the material web and the dye bath, and controlled, continuous convective heating and motion of the dye bath results in a curve of the continuous drop in instantaneous dyestuff concentrations against treatment time as shown in FIG. 1. After 2 minutes, a residual concentration of 10% is attained. The dye exhaustion is virtually complete, with a very low residual unextracted dye content.

While only several embodiments of the present invention have been shown and described, it will be apparent to persons skilled in the art that many changes and modifications may be made therein without departing from the spirit and scope of the present invention.

What is claimed:

1. Apparatus for the continuous liquid treatment of a running web of textile material comprising, in combination:

a. a lower, shallow, elongated horizontal treatment tank for containing treating liquid;

b. an upper, shallow, elongated horizontal treatment tank for containing treating liquid;

c. means for continuously feeding said web into the apparatus and subsequently into said lower treatment tank;

d. means for continuously withdrawing said web from said lower treatment tank and for subsequently feeding the web into said upper treatment tank;

e. means for continuously withdrawing said web from said upper treatment tank and for subsequently removing the treated textile web from the apparatus;

f. means for feeding treating liquid into said lower tank, means for withdrawing liquid therefrom and for subsequently feeding it to said upper tank, and means for withdrawing used liquid from the upper tank and for subsequently removing said used liquid from the apparatus;

g. said means for withdrawing liquid from said tanks including overflow means that serve to maintain a depth of liquid in said tanks sufficient to cover the entire structure of said textile material including all interstices and voids therein and to maintain a preselected ratio of circulating weight of textile material and treating liquid; and h. said means (c), (d), and (e) comprising roller means and said means for withdrawing liquid from said tanks including pump means, said roller means and said pump means serving to move the web and the treating liquid through the apparatus at substantially the same speed and in the same direction whereby substantially complete extraction of the treating agent is obtained.

2. The apparatus of claim 1 which includes a closed casing providing a chamber for containing steam or heated air for treating said textile web therein.

3. The apparatus of claim 1 which includes means for heating each of said elongated tanks located externally of said tanks.

4. The apparatus of claim 1 wherein means are provided for holding down the material web in said tanks so that the upper surface of said web is sufficiently covered by the liquid.

5. The apparatus of claim 1 in which the treating tanks are equipped at the exterior of the bottom thereof with spaced auxiliary heating elements extending transversely to the direction of motion of the web, said elements providing heat to said tanks by steam, hot water or high boiling heating liquids.

6. The apparatus of claim 1 in which said treating tanks and said means for feeding the web from the lower treatment tank to the upper treatment tank are enclosed in an overall casing to provide heat when filled with steam or air at elevated temperature.

7. The apparatus of claim 1 wherein said roller means includes a feed roller located outside the treatment space leading to the lower treatment tank, a lifting, deflecting and feed roller between the lower and upper treatment tanks and a drawout roller located at the exit of the upper treatment tank.

8. The apparatus of claim 1 in which the treatment tanks for reception and passage of treating liquid are equipped with stirring roller means for producing a stirring of the hot treating liquid transversely to the running direction of the material web.

* * * * *